US005167447A

United States Patent [19]

Gonzales

[11] Patent Number: 5,167,447

[45] Date of Patent: Dec. 1, 1992

[54] FLASHLIGHT USING DIFFERENT SIZE BATTERIES

[76] Inventor: Luis J. M. Gonzales, 28 Kaibab, Box 347, Grand Canyon, Ariz. 86023

[21] Appl. No.: 871,950

[22] Filed: Apr. 22, 1992

[51] Int. Cl.[5] ..... F21L 7/00; F21L 15/00

[52] U.S. Cl. ..... 362/202; 362/208

[58] Field of Search ..... 362/157, 202, 208, 457, 362/453

[56] References Cited

U.S. PATENT DOCUMENTS

| | | | |
|---|---|---|---|
| 3,510,644 | 5/1970 | Braese | 362/208 |
| 3,705,983 | 12/1972 | Yamada | 240/10.6 |
| 4,285,031 | 8/1981 | Reiss | 362/205 |
| 4,348,715 | 3/1982 | Christensen et al. | 362/202 |
| 4,777,582 | 10/1988 | Sharrah | 362/205 |
| 4,782,432 | 11/1988 | Coffman | 362/184 |
| 4,985,812 | 1/1991 | Uke | 362/202 |
| 5,006,969 | 4/1991 | Lai | 362/206 |

*Primary Examiner*—Richard R. Cole
*Attorney, Agent, or Firm*—John R. Flanagan

[57] ABSTRACT

A flashlight includes an elongated main barrel portion defining a main interior cavity for holding in an end-to-end relation to a pair of batteries of first and/or second diameter sizes being different from one another, a head portion for holding a flashlight bulb and being mounted at one end of the main barrel portion, an end cap removably attachable to an opposite end of the main barrel portion for opening and closing a rear opening thereof, and a first coil spring connected to the end cap for insertion into the main barrel portion for engaging and positioning a rear end one of the batteries of the first or second diameter sizes received within the interior cavity of the main barrel portion. The flashlight also includes a removable second annular spring member disposed in concentric relation to and of larger diameter than the first spring for extending about and positioning within the main barrel portion the batteries of the second diameter size being smaller than the batteries of the first diameter size. The flashlight further an elongated auxiliary barrel portion mounted along the exterior of the main barrel portion for holding in an end-to-end relation batteries of a third diameter size.

20 Claims, 3 Drawing Sheets

FLASHLIGHT USING DIFFERENT SIZE BATTERIES

BACKGROUND OF THE INVENTION

1. Field of the Invention

The present invention generally relates to flashlights and, more particularly, is concerned with a flashlight capable of using different size batteries.

2. Description of the Prior Art

Conventional flashlights typically include an elongated barrel portion for gripping by the hand of a user and a head portion for holding a flashlight bulb. The head portion is threaded onto one end of the barrel portion. Such conventional flashlights are powered by two or more drycell batteries connected in series and housed within the barrel portion. The barrel portion includes a tail cap at the opposite end which must be removed in order to replace the batteries.

Also, the barrel portion mounts a switching mechanism near the head portion having a movable contact for making and breaking an electrical circuit extending from a terminal of the battery in the barrel portion to the flashlight bulb mounted to the head portion. The movable contact of the switching mechanism can slide fore and aft along the exterior of the barrel portion so as to be brought into contact with or displaced from contact with a pair of spaced terminals of the electrical circuit of the flashlight located adjacent the switching mechanism.

The head portion of the flashlight includes a parabolic-shaped reflector which has a central opening through which the flashlight bulb is mounted. When the head portion is threaded onto the barrel portion, the reflector butts up against and makes electrical contact with an end of one of the stationary terminal of the electrical circuit located adjacent to one side of the switching mechanism. The electrical circuit also includes a conductor coil spring mounted in the end cap of the flashlight so as to electrically engage and force the batteries forwardly into electrical contact with the rear terminal end of the flashlight bulb.

Conventional flashlights of this type have one significant disadvantage. The barrel portion of the flashlight is designed to accommodate and contain drycell batteries of only one given size (diameter and length). As a result, should one battery be used up or defective the flashlight will be rendered inoperative until a replacement battery of the same size can be obtained. Consequently, a need still remains for improvements in the design of a conventional flashlight of this type so as to overcome the above-described disadvantage.

SUMMARY OF THE INVENTION

The present invention provides a flashlight designed to overcome the above-described disadvantage and satisfy the aforementioned need. The flashlight of the present invention has improved versatility in that it is capable of using different size batteries. Thus, if a battery of the one size being used is no longer any good, the user is likely to be able to quickly find batteries of another size to take the place of the batteries being used.

Accordingly, the present invention is directed to a flashlight for using different size batteries, which comprises: (a) an elongated main barrel portion having a pair of opposite ends and defining a main interior cavity extending between the opposite ends of the main barrel portion and being capable of receiving and containing at least one battery of a first diameter size or at least one battery of a second diameter size being smaller than the first diameter size; (b) a head portion mounted at one end of the main barrel portion and capable of holding a flashlight bulb for engagement by the respective one of the batteries of the first or second diameter size received in the main interior cavity of the main barrel portion; (c) a main end cap removably attachable to an opposite end of the main barrel portion for opening and closing a rear opening thereof; (d) a main resiliently flexible elastic member connected to and extending from the main end cap for insertion into the main interior cavity of the main barrel portion and for engaging and positioning the respective one of the batteries of the first or second diameter size received in the main interior cavity of the main barrel portion; and (e) an annular member removably insertable about the main elastic member, the annular member being smaller in diameter than the main barrel portion so as to permit insertion of the annular member into the main barrel portion, the annular member being larger in diameter than the battery of the second diameter size so as to be capable of insertion about and positioning of the battery of the second diameter size within the main barrel portion. Preferably, the main interior cavity of the barrel portion is capable of holding in an end-to-end relation at least a pair of the batteries of the first diameter size, at least a pair of the batteries of the second diameter size, or at least a pair of batteries of the first and second diameter sizes. The main elastic member is a first coil spring. The annular member is another coil spring being greater in length and larger in diameter than the first coil spring and being disposable concentrically about the first coil spring.

Also, the flashlight comprises an elongated auxiliary barrel portion being mounted to the main barrel portion so as to extend along the exterior thereof. The auxiliary barrel portion has a pair of opposite ends and define an auxiliary interior cavity extending between the opposite ends of the auxiliary barrel portion. The auxiliary interior cavity is capable of receiving and positioning at least one battery of a third diameter size being smaller than the first and second diameter sizes. Preferably, the auxiliary interior cavity is capable of receiving and positioning in an end-to-end relation at least a pair of the batteries of the third diameter size.

Further, the flashlight comprises an auxiliary end cap removably attached to one of the opposite ends of the auxiliary barrel portion and an auxiliary resiliently flexible elastic member connected to and extending from the auxiliary end cap for insertion into the auxiliary interior cavity of the auxiliary barrel portion and for engaging and positioning the battery of the third diameter size received within the auxiliary interior cavity of the auxiliary barrel portion. Preferably the auxiliary elastic member is a second coil spring being smaller in diameter than the first coil spring.

Still further, the flashlight comprises a switching mechanism slidably mounted on the exterior of the main barrel portion, a main electrical conductor arrangement mounted to the main barrel portion and electrically interconnecting the switching mechanism with the head portion and the main elastic member, and an auxiliary electrical conductor arrangement mounted to the auxiliary barrel portion and electrically connected to the main electrical conductor arrangement and the head portion. The auxiliary electrical conductor arrangement is capable of electrically connecting a front end of a forward one and a rear end of a rear one of the pair of batteries of the third diameter size received in the auxiliary barrel portion respectively to the main electrical conductor arrangement and the head portion.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
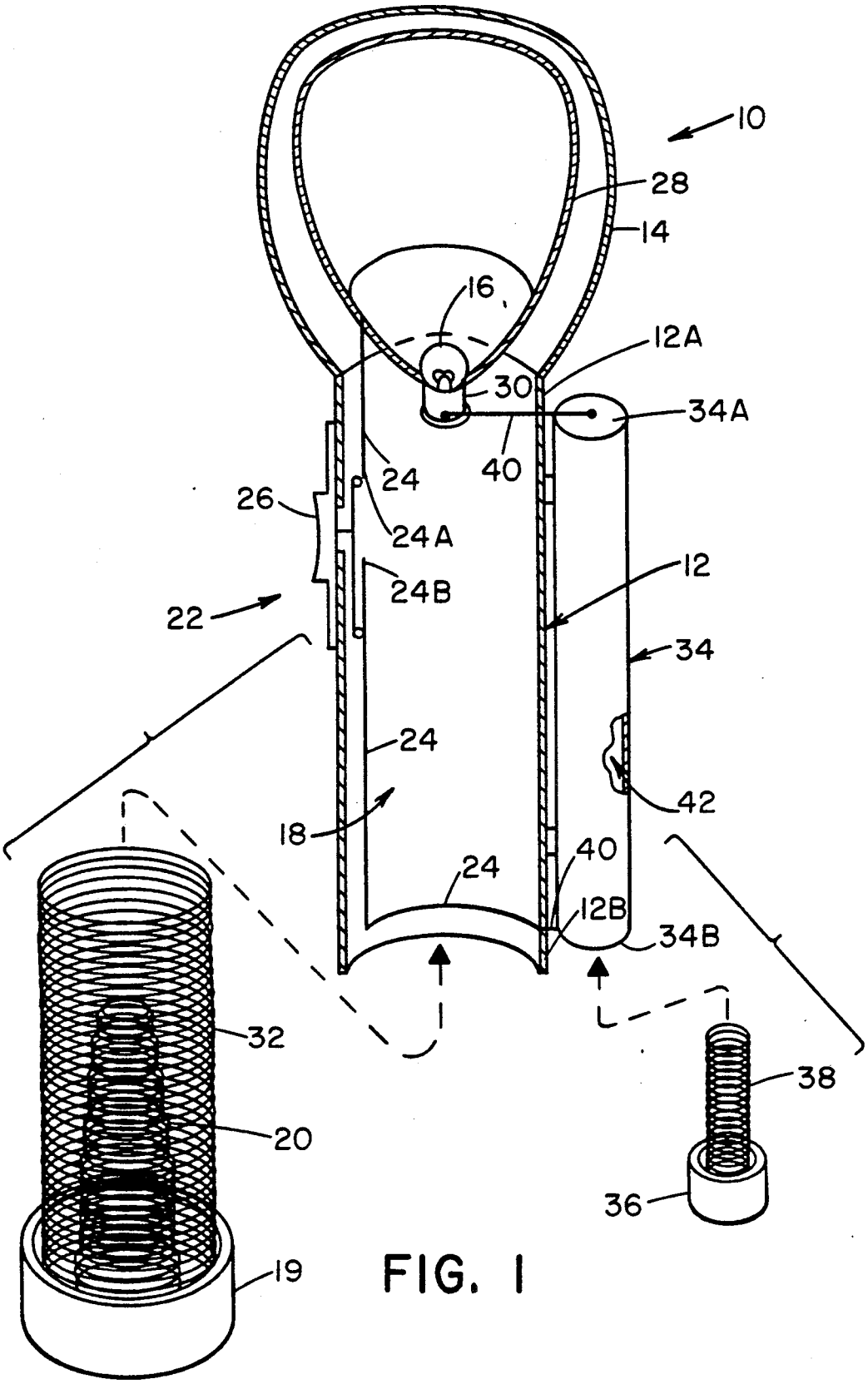
FIG. 1 is an exploded longitudinally-sectioned perspective view of a flashlight adapted to use batteries of different sizes in accordance with the improved features of the present invention.
Figure 2:
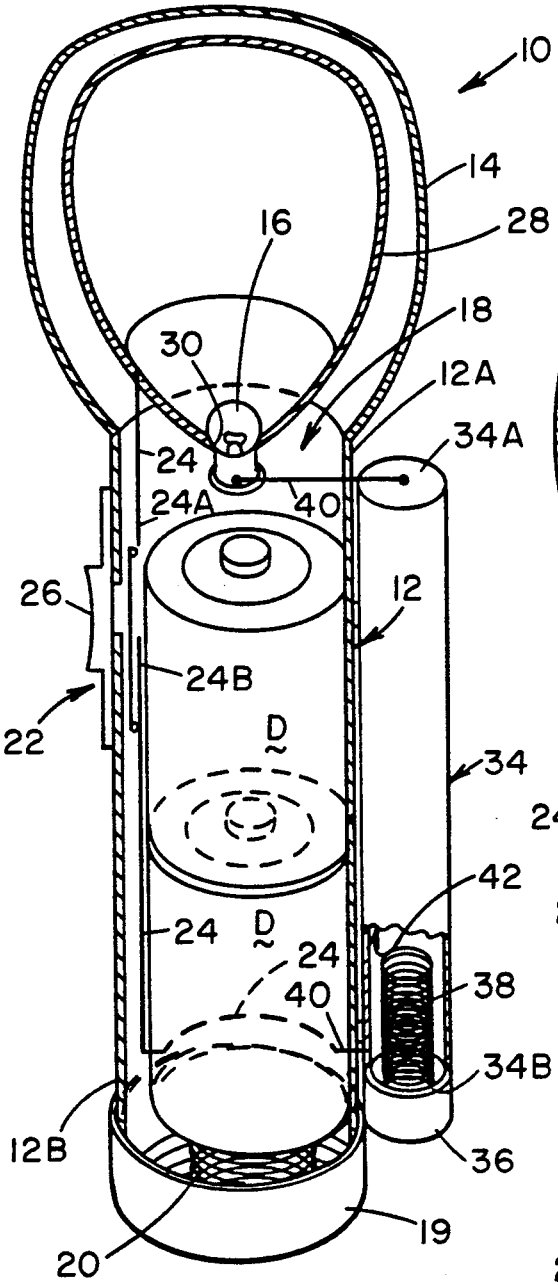
FIG. 2 is an assembled longitudinally-sectioned perspective view of the flashlight of FIG. 1 with a pair of batteries of a first or D size installed in a main barrel portion of the flashlight.

Referring to the drawings, and particularly to FIGS. 1 and 2, there is illustrated a flashlight, generally designated 10, which incorporates the features of the present invention. The flashlight 10 include an elongated main barrel portion 12 having a generally cylindrical shape for gripping by the hand of a user and a head portion 14 for holding a flashlight bulb 16. The head portion 14 is threaded onto a front end 12A of the main barrel portion 12. The main barrel portion 12 defines a generally cylindrical main interior cavity 18 extending between the front and rear ends 12A, 12B of the main barrel portion 12. The main interior cavity 18 of the main barrel portion 12 preferably has a length and diameter adapted to receive and contain two D size drycell batteries (FIG. 2) in an end-to-end relation for powering the light bulb 16 of the flashlight 10. The head portion 14 is positioned for engagement by the front end of the D size battery received in the main interior cavity 18 of the main barrel portion 12.

The flashlight 10 also includes a tail or main end cap 19 and a main resiliently-flexible elastic member 20, such as a first coil spring 20. The main end cap 19 is threaded onto an opposite open rear end 12B of the main barrel portion 12 and must be unthreaded and removed in order to replace the D size batteries. The main or first coil spring 20 is connected to and extends from the main end cap 19 for insertion into the main interior cavity 18 of the main barrel portion 12. The main coil spring 20 will engage the rear end of the rear one of the D size batteries and will position the batteries as desired in the main interior cavity 18 of the main barrel portion 12.

The flashlight 10 further includes a switching mechanism 22 slidably mounted on the exterior of the main barrel portion 12, and a main electrical conductor arrangement 24 mounted to the main barrel portion 12 and electrically interconnecting the switching mechanism 22 with the head portion 14 and the main or first coil spring 20. The switching mechanism 22 is located near the head portion 14 and includes a movable contact 26 for making and breaking electrical contact with spaced terminal ends 24A, 24B of the main electrical conductor arrangement 24. The switching mechanism 24 in conjunction the main electrical conductor arrangement 24, the head portion 14 and the first coil spring 20 together with the two D size batteries in the main barrel portion 12 and the light bulb 16 define a main electrical circuit of the flashlight 10. The movable contact 26 of the switching mechanism 24 when engaged by the user's finger can be slid fore and aft along the exterior of the main barrel portion 12 so as to make or break the electrical connection between the pair of spaced terminals 24A, 24B of main electrical conductor arrangement 24.

The head portion 14 of the flashlight 10 includes a parabolic-shaped reflector 28 which has a central opening 30 through which the light bulb 16 is mounted. When the head portion 14 is threaded onto the main barrel portion 12, the reflector 28 abutts up against and makes electrical contact with a portion of the main electrical conductor arrangement 24. The first coil spring 20 mounted in the end cap of the flashlight is electrically conductive and forces the D size batteries forwardly into electrical contact with the rear terminal end of the flashlight bulb 16.

Figure 3:
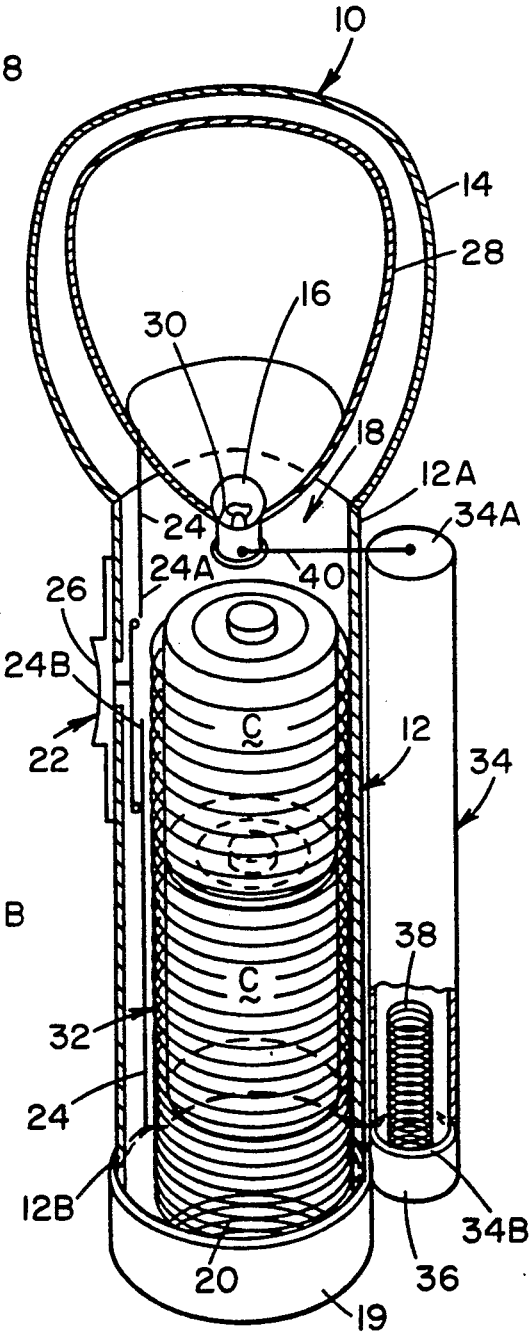
FIG. 3 is an assembled longitudinally-sectioned perspective view of the flashlight of FIG. 1 with a pair of batteries of a second or C size installed in the main barrel portion of the flashlight.
Figure 4:
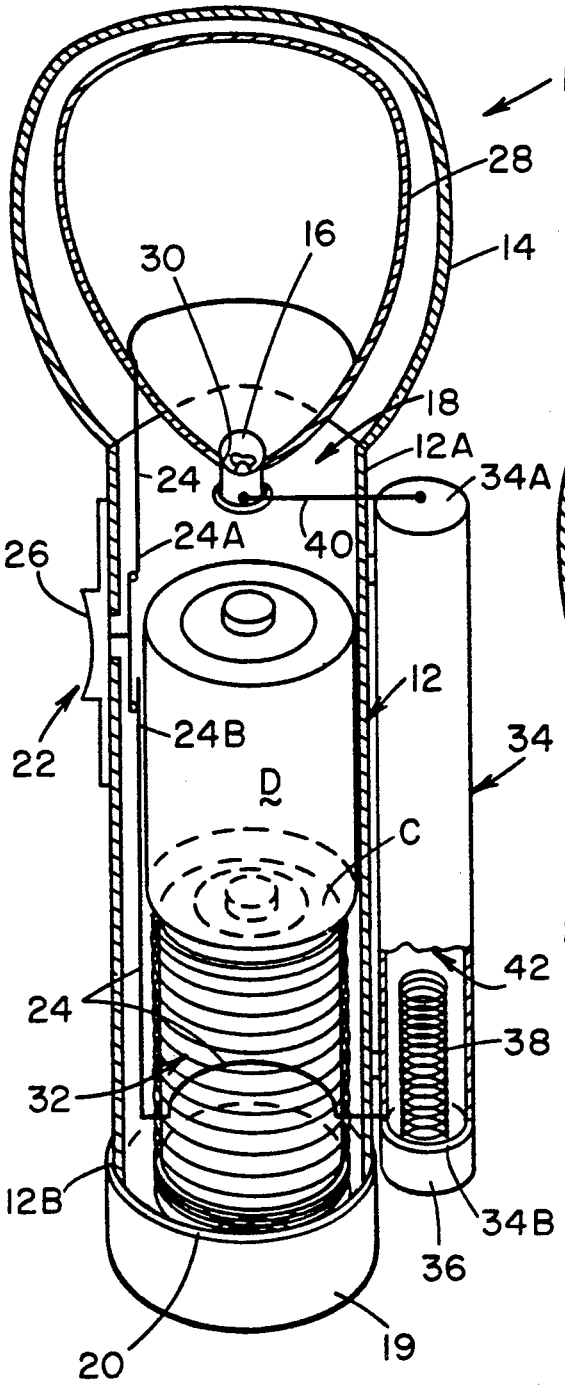
FIG. 4 is an assembled longitudinally-sectioned perspective view of the flashlight of FIG. 1 with a pair of batteries of the first or D size and the second or C size installed in the main barrel portion of the flashlight.
Figure 5:
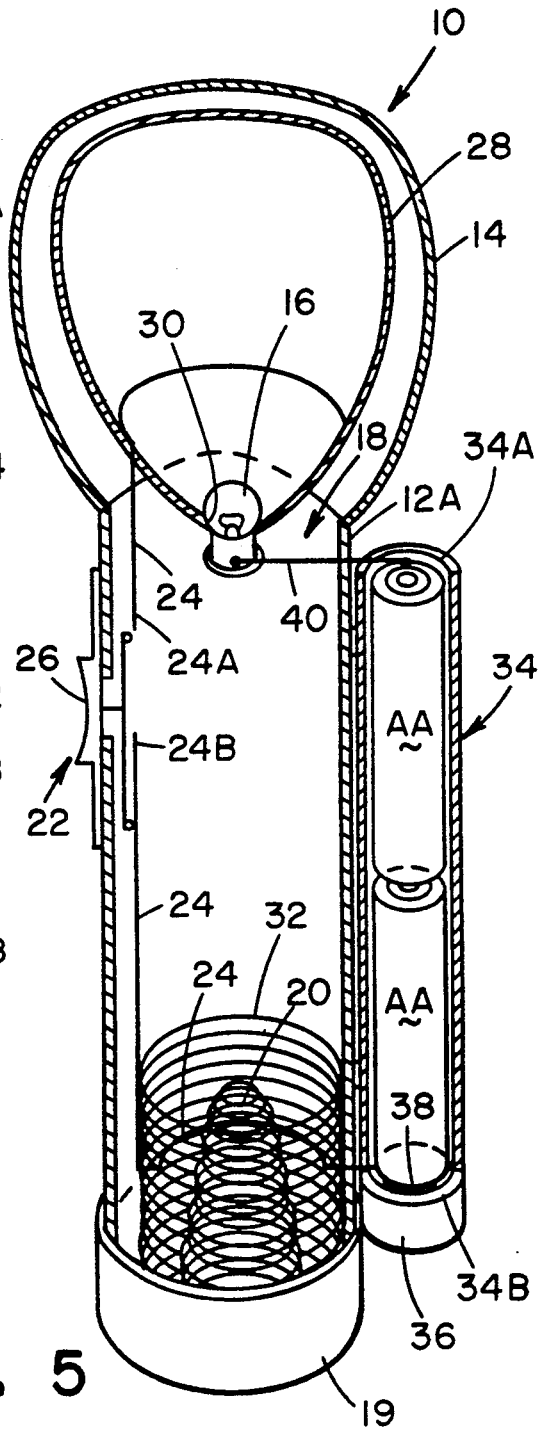
FIG. 5 is an assembled longitudinally-sectioned view of the flashlight of FIG. 1 with a pair of batteries of a third or AA size installed in an auxiliary barrel portion of the flashlight.

Referring to FIGS. 1–5, in accordance with the principles of the present invention, the flashlight 10 incorporates improved features which make it capable of using not only the two D size batteries (as seen in FIG. 2), but also other batteries of different diameter (and length) sizes, for example, two AA size batteries (as seen in FIG. 5), two C size batteries (as seen in FIG. 3), or one C size battery and one D size battery (as seen in FIG. 4). However, it should be understood that the principles of the present invention are equally applicable to a flashlight 10 constructed to use a single or more than two AA size batteries, C size batteries, or D size batteries.

A first of the improved features incorporated by the flashlight 10 is an elongated annular member 32 removably insertable within the main barrel portion 12 about the main or first coil spring 20. The annular member 32 which removably seats in the main end cap 19 is preferably an insulated coil spring 32 which is smaller in diameter than the main barrel portion 12 so as to permit insertion of the annular member 32 into the main barrel portion 12. Also, the annular member 32 is larger in diameter than the C size battery (having the second diameter size smaller than the D size battery) so as to be capable of insertion about and to properly position the two C size batteries within the main interior cavity 18 of the main barrel portion 12 by filling the annular void or space between the two C size batteries and the main barrel portion 12. The annular member 32 is greater in length and larger in diameter than the first coil spring 20 and is disposable concentrically about the first coil spring 20.

A second of the improved features incorporated by the flashlight 10 is an elongated auxiliary barrel portion 34, an auxiliary end cap 36, an auxiliary resiliently-flexible elastic member 38, and an auxiliary electrical conductor arrangement 40. The auxiliary barrel portion 34 is shorter in length and smaller in diameter than the main barrel portion 12. The auxiliary barrel portion 34 is mounted to the main barrel portion 12 so as to extend along the exterior thereof. The auxiliary barrel portion 34 has a pair of opposite ends 34A, 34B, the front end 34A being closed and the rear end 34B being open. Also, the auxiliary barrel portion 34 defines an auxiliary interior cavity 42 extending between the opposite ends 34A, 34B of the auxiliary barrel portion 34. The auxiliary interior cavity 42 is capable of receiving and positioning in end-to-end relation the two AA size batteries (being of the third diameter size less than the first and second diameter sizes of the D size and C size batteries).

The auxiliary end cap 36 is removably attached to the rear open end 34B of the auxiliary barrel portion 34 so as to close the same. The auxiliary elastic member 38 is a second electrically conductive coil spring 38 connected to and extending from the auxiliary end cap 38 for insertion into the auxiliary interior cavity 42 of the auxiliary barrel portion 34 and for engaging the rear end of the rear AA size battery and properly positioning the two AA size batteries within the auxiliary interior cavity 42 of the auxiliary barrel portion 34. The auxiliary elastic member or second coil spring 38 is shorter in length and smaller in diameter than said main or first coil spring 20.

The auxiliary electrical conductor arrangement 40 is mounted to the auxiliary barrel portion 34 and is electrically connected to the main electrical conductor arrangement 24 and the head portion 14. The auxiliary electrical conductor arrangement 40 also is capable of electrically connecting the front end of the front one and the rear end of the rear one of the two AA size batteries (as shown in FIG. 5) respectively to the head portion 14 and to the main electrical conductor arrangement 24.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

Having thus described the invention, what is claimed is:

1. A flashlight for using different size batteries, comprising:

(a) an elongated main barrel portion having a pair of opposite ends and defining a main interior cavity extending between said opposite ends of said main barrel portion, said main interior cavity being capable of receiving and containing at least one battery of a first diameter size or at least one battery of a second diameter size being smaller than said first diameter size;

(b) a head portion mounted at one end of said main barrel portion and capable of holding a flashlight bulb for engagement by a respective one of the batteries of the first or second diameter size received in said main interior cavity of said main barrel portion;

(c) a main end cap removably attachable to an opposite end of said main barrel portion for opening and closing a rear opening thereof;

(d) a main resiliently flexible elastic member connected to and extending from said main end cap for insertion into said main interior cavity of said main barrel portion and for engaging and positioning the respective one of the batteries of the first or second diameter size received in said main interior cavity of said main barrel portion; and (e) an annular member removably disposed about said main elastic member, said annular member being smaller in diameter than said main barrel portion so as to permit insertion of said annular member into said main barrel portion, said annular member being larger in diameter than the battery of the second diameter size so as to be capable of insertion about and positioning of the battery of the second diameter size within said main barrel portion.

2. The flashlight of claim 1 further comprising:

a switching mechanism slidably mounted on an exterior of said main barrel portion; and a main electrical conductor arrangement mounted to said main barrel portion and electrically interconnecting said switching mechanism with said head portion and said main elastic member.

3. The flashlight of claim 1 wherein said main interior cavity of said main barrel portion is capable of holding in an end-to-end relation at least a pair of the batteries of the first diameter size, at least a pair of the batteries of the second diameter size, or at least a pair of batteries of the first and second diameter sizes.

4. The flashlight of claim 1 wherein said main elastic member is a first coil spring.

5. The flashlight of claim 4 wherein said annular member is another coil spring being greater in length than said first coil spring, being larger in diameter than said first spring, and being disposable concentrically about said first coil spring.

6. The flashlight of claim 1 further comprising:

an elongated auxiliary barrel portion having a pair of opposite ends and defining an auxiliary interior cavity extending between said opposite ends thereof, said auxiliary interior cavity being capable of receiving and positioning at least one battery of a third diameter size being smaller than the first and second diameter sizes, said auxiliary barrel portion being mounted to said main barrel portion so as to extend along an exterior thereof.

7. The flashlight of claim 6 wherein said auxiliary interior cavity is capable of receiving and positioning in an end-to-end relation at least a pair of the batteries of the third diameter size.

8. The flashlight of claim 6 further comprising:

an auxiliary end cap removably attached to one of said opposite ends of said auxiliary barrel portion.

9. The flashlight of claim 8 further comprising:

an auxiliary resiliently flexible elastic member connected to and extending from said auxiliary end cap for insertion into said auxiliary interior cavity of said auxiliary barrel portion and for engaging and positioning the battery of the third diameter size received within said auxiliary interior cavity of said auxiliary barrel portion.

10. The flashlight of claim 9 wherein:

said main elastic member is a first coil spring; and said auxiliary elastic member is a second coil spring being smaller in diameter than said first coil spring.

11. The flashlight of claim 9 further comprising:

a switching mechanism slidably mounted on the exterior of said main barrel portion;

a main electrical conductor arrangement mounted to said main barrel portion and electrically interconnecting said switching mechanism with said head portion and main elastic member; and an auxiliary electrical conductor arrangement mounted to said auxiliary barrel portion and electrically connected to said main electrical conductor arrangement and said head portion, said auxiliary electrical conductor arrangement being capable of electrically connecting opposite ends of the at least one battery of the third diameter size respectively to said main electrical conductor arrangement and said head portion.

12. The flashlight of claim 11 wherein said auxiliary electrical conductor arrangement is capable of electrically connecting a front end of a forward one and a rear end of a rear one of a pair of the batteries of the third diameter size received in said auxiliary barrel portion respectively to said main electrical conductor arrangement and said head portion.

13. A flashlight for using different size batteries, comprising:

(a) an elongated main barrel portion having a pair of opposite ends and defining a main interior cavity extending between said opposite ends of said main barrel portion, said main interior cavity being capable of receiving and containing at least one battery of a first diameter size;

(b) a head portion mounted at one end of said main barrel portion and capable of holding a flashlight bulb for engagement by the battery of the first diameter size received in said main interior cavity of said main barrel portion;

(c) a main end cap removably attachable to an opposite end of said main barrel portion for opening and closing a rear opening thereof;

(d) a main resiliently flexible elastic member connected to and extending from said main end cap for insertion into said main interior cavity of said main barrel portion and for engaging and positioning the battery of the first diameter size received in said main interior cavity of said main barrel portion; and (e) an elongated auxiliary barrel portion having a pair of opposite ends and defining an auxiliary interior cavity extending between said opposite ends thereof, said auxiliary interior cavity being capable of receiving and positioning at least one battery of another diameter size being smaller than the first diameter size, said auxiliary barrel portion being mounted to said main barrel portion so as to extend along an exterior thereof.

14. The flashlight of claim 13 wherein said auxiliary interior cavity is capable of receiving and positioning in an end-to-end relation at least a pair of the batteries of the another diameter size.

15. The flashlight of claim 13 further comprising:

an auxiliary end cap removably attached to one of said opposite ends of said auxiliary barrel portion.

16. The flashlight of claim 15 further comprising:

an auxiliary resiliently flexible elastic member connected to and extending from said auxiliary end cap for insertion into said auxiliary interior cavity of said auxiliary barrel portion and for engaging and positioning the battery of the another diameter size received within said auxiliary interior cavity of said auxiliary barrel portion.

17. The flashlight of claim 16 wherein:

said main elastic member is a first coil spring; and said auxiliary elastic member is a second coil spring being smaller in diameter than said first coil spring.

18. The flashlight of claim 13 further comprising:

a switching mechanism slidably mounted on the exterior of said main barrel portion;

a main electrical conductor arrangement mounted to said main barrel portion and electrically interconnecting said switching mechanism with said head portion and main elastic member; and an auxiliary electrical conductor arrangement mounted to said auxiliary barrel portion and electrically connected to said main electrical conductor arrangement and said head portion, said auxiliary electrical conductor arrangement being capable of electrically connecting opposite ends of the at least one battery of the another diameter size respectively to said main electrical conductor arrangement and said head portion.

19. The flashlight of claim 18 wherein said auxiliary electrical conductor arrangement is capable of electrically connecting a front end of a forward one and a rear end of a rear one of a pair of the batteries of the another diameter size received in said auxiliary barrel portion respectively to said main electrical conductor arrangement and said head portion.

20. The flashlight of claim 13 wherein said main interior cavity of said barrel portion is capable of holding in an end-to-end relation at least a pair of the batteries of the first diameter size.

* * * * *